US007175364B2

(12) United States Patent
Gaertner et al.

(10) Patent No.: US 7,175,364 B2
(45) Date of Patent: Feb. 13, 2007

(54) SUCTION DEVICE AND SUCTION METHOD FOR THE DISPOSAL OF DUST IN MILLING MACHINES

(75) Inventors: Olaf Gaertner, Linz/Rhein (DE); Christian Berning, Euskirchen (DE); Dieter Simons, Buchholz (DE)

(73) Assignee: Wirtgen GmbH, Windhagen (DE)

( * ) Notice: Subject to any disclaimer, the term of this patent is extended or adjusted under 35 U.S.C. 154(b) by 82 days.

(21) Appl. No.: 10/514,442

(22) PCT Filed: May 6, 2003

(86) PCT No.: PCT/EP03/04691

§ 371 (c)(1),
(2), (4) Date: Nov. 16, 2004

(87) PCT Pub. No.: WO03/100172

PCT Pub. Date: Dec. 4, 2003

(65) Prior Publication Data

US 2005/0179308 A1 Aug. 18, 2005

(30) Foreign Application Priority Data

May 28, 2002 (DE) ..... 102 23 819

(51) Int. Cl.
*E01C 23/00* (2006.01)
*E01C 19/05* (2006.01)

(52) U.S. Cl. ..... 404/76; 404/75; 404/94

(58) Field of Classification Search ..... 404/76, 404/90–94, 75; 299/64
See application file for complete search history.

(56) References Cited

U.S. PATENT DOCUMENTS 1,459,968 A * 6/1923 Bailly ..... 15/346
4,561,145 A * 12/1985 Latham ..... 15/346
5,092,658 A * 3/1992 Smith ..... 299/39.4
5,215,071 A * 6/1993 Mertes et al. ..... 125/13.01
5,605,381 A * 2/1997 Schmoock et al. ..... 299/39.2
6,195,837 B1 * 3/2001 Vanderlinden ..... 15/348
6,210,071 B1 * 4/2001 McSharry ..... 404/94
6,296,318 B1 * 10/2001 Simons et al. ..... 299/39.2
6,733,086 B1 * 5/2004 McSharry et al. ..... 299/64

FOREIGN PATENT DOCUMENTS

DE 34 05 473 A1 10/1985
DE 38 31 161 C1 9/1988
DE 39 03 482 A1 8/1990

* cited by examiner

*Primary Examiner*—Raymond Addie

(74) *Attorney, Agent, or Firm*—Diller, Ramik & Wight

(57) ABSTRACT

Disclosed is an automotive milling machine for machining ground surfaces, comprising an engine frame (2), a movable milling drum (8) which is mounted on the engine frame (2), at least one conveying device (14, 18) which is arranged on the engine frame (2) and takes over the milled material (3) from the milling drum (8) at a transfer location (5), and a device (20) sucking off the air that is polluted with dust and fumes. The milled material (3) is enclosed by a duct (16, 16*a*, 16*b*) on the at least one conveying device (14, 18), said duct (16) being separated into two sections (16*a*, 16*b*). The suction device (20) is connected to the first section (16*a*) of the duct (16) downstream from the first transfer location (5) and sucks off the air that has been polluted during milling at the milling drum (8) as well as inside the first section (16*a*) of the duct (16) essentially in the direction in which the material is conveyed.

19 Claims, 6 Drawing Sheets

SUCTION DEVICE AND SUCTION METHOD FOR THE DISPOSAL OF DUST IN MILLING MACHINES

BACKGROUND OF THE INVENTION

The invention relates to an automotive milling machine for machining ground surfaces, particularly roadways, as well as to a method for the disposal of dusts and fumes at a milling machine, which are produced during the milling.

Such milling machines are also called road milling machines.

A front loader milling machine, for example, is known from DE-A-39 03 482 or DE-A 38 31 161. The known milling machines comprise an automotive running gear with a pair of front wheels and a pair of rear wheels. The running gear supports a machine frame in which a milling drum is supported transverse to the traveling direction. To achieve a transportation of the milled-off material that is as complete as possible, the milling drum is typically surrounded by a housing in which the wall pointing towards the traveling direction is configured as a covering shield with a passage opening for the milled-off material. That wall that is the rear one in traveling direction is configured as a stripper and pressed against the milled surface to seal the drum box to the rear in order to supply the milled-off material completely to transportation. The milling drum throws the material worked off by the milling drum onto a first band conveyor which transfers the worked-off material onto a stacker belt at the front end of the milling machine, which is pivotable with respect to its inclination and laterally for the transport onto a floor of a truck.

Another embodiment of these road milling machines, the so-called rear loader milling machine, is known from DE-A 34 05 473, for example. Here, the passage opening for the milled-off material is located in the wall of the drum housing pointing toward the direction opposite to the traveling direction and also being configured as a stripper. The material milled off by the milling roll is directly transferred onto the band conveyor serving as stacker belt and being arranged at the rear end of the milling machine to transport it onto a truck. Like the stacker belt of the front loader milling machine, the stacker belt of the rear loader milling machine may also be pivotable in its inclination and laterally.

The milling drum of such road milling machines is fitted with chisel tools forming a conveying helix transporting the milled-off material to the passage opening of the covering shield.

By milling off the ground surface and by transporting the milled-off material, dusts and fumes are produced which may impair the operativeness of the conveying devices, on the one hand, and worsen the working conditions for the machine operator on the driver stand and for the remaining operating personnel about the milling machine, on the other hand, and possibly even be an obstacle to the view for the traffic that is possibly passing.

From EP 0 971 075, it is already known to provide the band conveyors of a milling machine with a hood, to suck off the produced dust at the milling drum and under the hood of the band conveyors opposite to the transport direction and to dispose of it via a blower and a filtering means at the rear end of the milling machine. It is disadvantageous that the sucking is effected at the band conveyors opposite to the transport direction. Due to the fact that the dusty air is sucked off rearward and opposite to the actual transport direction of the material, considerable additional efforts for the conversion of the machine and a distinctly higher air output of the blower are required. The use of a radial fan at the rear end of the milling machine has the disadvantage that it is not possible to achieve a sufficiently high airflow at the band conveyors that are at the front in the direction of travel. Finally, the particles discarded at the blower and the cyclone filter are thrown onto the ground surface again whereby the ground surface just milled off is soiled again. The cyclone filter provided at the rear end of the machine is only able to segregate the coarser particles but not the respirable fine dusts so that the arrangement of the air outlet at the rear end of the milling machine is arranged too close to the driver stand. The same applies to a mesh-shaped filter that is not able to segregate respirable dusts either. Another disadvantage of prior art consists in that dusts and fumes are blown off at the rear end of the milling machine near the driver stand and that, moreover, dusts are inevitably produced anew when the milled-off material is thrown off at the front band conveyor.

SUMMARY OF THE INVENTION

Therefore, it is the object of the invention to provide a milling machine of the afore-mentioned kind as well as a method for the disposal of dusts and fumes where dusts and fumes produced upon milling and conveying can be sucked off with lower requirements as to the machines and with higher efficiency and disposed of together with the worked-off material.

The invention advantageously provides that the suction device is connected to a first section of the duct allocated to the conveying device downstream from the first transfer location and sucks off the air that has been polluted during milling essentially in the direction in which the material is conveyed in the first duct section, the polluted air being sucked off at the milling drum as well.

The invention permits a simple construction where the structure of a milling machine does not have to be changed fundamentally so that a retrofitting of existing milling machines is possible as well.

Sucking off the polluted air in the first duct section permits a sucking near the greatest source of pollution where dusts and fumes are produced. At the milling drum, dusts are produced by breaking up the ground surface and fumes are produced because of the high temperatures during milling, e.g., during milling off asphalt materials. As things develop, dusts may also be produced in the region of the conveying device by the transport of the milled-off material. The arrangement of the suction device in the first duct section of the conveying device permits the application of a strong airflow in the region of the milling roll and the first duct section whereby the discharge of dusts or fumes at the milling roll or at the first duct section is avoided. Therefore, dusts and fumes can be sucked off reliably in the working range of the milling roll and at the location of transfer from the milling roll onto the conveying device. An essential advantage is the improvement of the working conditions on the driver stand and in the environment of the milling machine and the low fault liability of the conveying device. Moreover, the milled ground surface is left clean. An essential advantage of the disposal of the dusts and fumes via the discharge of the conveying means consists in that the development of dust is nearly unavoidable at this site since the milled-off material is thrown off onto the floor of a transport vehicle from a height of several meters. The invention advantageously provides that the dusts and fumes are disposed of exactly where the development of dust is unavoidable anyway. For reasons of working security, standing there is strictly forbidden anyway. The working area on the driver stand and next to the machine, however, is freed from dusts and fumes and particularly from their respirable fractions.

Preferably, the second duct section is separated from the first duct section by separating means for blocking up an airflow without hindering a conveyance of the material.

Preferably, it is provided that the suction device comprises a suction duct connected to the first duct section and an axial fan integrated into the suction duct. The polluted air is disposed of by the first duct section via the suction duct, the axial fan integrated in the suction duct providing for a high negative pressure and a high airflow speed at the suction locations. Another advantage of the axial fan consists in that it can be integrated into the suction duct and is thus arranged in a room-saving manner and simultaneously, it can be arranged close to the suction locations. Another advantage of the axial fan is its indifference to dirt and its self-cleaning effect. The high sucking power does not only permit to suck off respirable dusts and fumes but, moreover, of coarser dust particles as well.

The suction device disposes of the polluted air at that site where dust develops anyway as a consequence of the discharge of the milled-off material from the conveying device.

According to an embodiment of the invention, it is provided that the downstream end of the suction duct opens into an upper section of the second duct section formed by the conveying device. By returning the sucked-off polluted air into the second duct section of the conveying device, it is possible to dispose of the polluted air together with the milled-off material far from the driver stand of the milling machine. By the polluted air entering into the second duct section, the second duct section is also sucked off in the direction in which the material is conveyed because of the injection effect.

The downstream end of the suction duct opens into a second duct section separated from the first duct section by separating means for blocking up an airflow without hindering the transport of the milled-off material. Consequently, a divided duct is formed which extends over the entire length of the conveying device, the separations being effected by the separating means which, on the one hand, do not hinder the transport of the milled-off material and, on the other hand, prevent an airflow opposite to the direction in which the material is conveyed. Thus, the duct sections are sealed off with respect to each other in a substantially air-tight manner.

Preferably, it is provided that the conveying device comprises at least one band conveyor with a conveyor belt and that sealing means for the duct consist of hoods sealing against the conveyor belt or against the housing of the band conveyor. Thus, the hoods form a closed duct together with the conveyor belt or together with the housing of the band conveyor so that the milled-off material travels through the conveying device in a completely peripherally enclosed manner. Thus, no dusts or fumes may emerge to the outside.

A second conveying device may take over the milled-off material at the end of the first conveying device at a second transfer location.

The transfer location between the first and the second conveying device is sealed with flexible sealing means mounted to at least one of the conveying devices. Smaller gaps do not matter since both the first duct section and the lower portion of the second duct section are under a negative pressure so that no polluted air can escape at possible leakages but air is sucked at most.

Preferably, the suction duct enters into the second duct section at an acute angle and shortly in front of the discharge end. The entrance angle reinforces the injection effect so that the lower portion of the second duct section is reliably sucked as well, without any additional suction device.

In a preferred embodiment of the invention, it is provided that an agglomeration means is arranged behind the junction of the suction duct and the second duct section. By means of the agglomeration means, the dusts and fumes can be agglomerated and condensed, respectively, so that they can be disposed of together with the milled-off material.

The agglomeration means may consist of, e.g., a water spraying means arranged at the outlet of the conveying means. By means of the water spraying means, the dusts can be bound and agglomerated and the fumes can be condensed as well.

Alternatively, with respect to the dusts, it is also possible to precipitate them electrostatically.

Between the first and the second duct section of the conveying device, at least one flexible flap is arranged as a separating means downstream and not far from the air intake fitting of the suction device, blocking up the first duct section of the conveying device against air entering opposite to the direction in which the material is conveyed. The milled-off material can pivot the flap in the direction in which the material is conveyed whereas the entry of air opposite to the direction in which the material is conveyed is prevented. The negative pressure in front of the flap reinforces the sealing by sucking the flap onto the milled-off material on the conveyor belt.

If the conveying device is formed of several conveying devices, the separating means is preferably provided at the first conveying device.

The flap may be repeatedly divided by vertically extending slots so that the flap are able to adapt to the contour of the material conveyed on the band conveyor. Preferably, several flaps, divided and/or undivided, are provided behind each other between the first and the second duct section.

At the sides of the at least one conveyor belt, the conveying device comprises hood supports sealed with respect to the conveyor belt by an elastic lip. Thus, the conveyor belt, together with the elastic lip, the hood support and the hoods, forms a completely closed duct cross section tightly enclosing the conveyed milled-off material. Alternatively, the duct cross section may also be formed by several hood portions.

According to the method for the disposal of the air polluted with dusts and fumes during milling at a milling machine for machining ground surfaces, where the material milled off by a milling drum is disposed of via at least one conveying device.

According to a preferred embodiment, the following steps are provided:

forming a duct about the milled-off material on the conveying device, divided in the transport direction, comprising a first duct section and a second duct section connected to the first duct section, the milled-off material being able to enter into the second duct section from the first duct section in an unhindered manner, an airflow between the first and the second duct section and particularly opposite to the material flow direction, however, being prevented, sucking off the polluted air in the first duct section of the conveying device by means of a blower in the direction in which the milled-off material is conveyed, and guiding the polluted air in a suction duct substantially parallel to the direction in which the milled-off material is conveyed, introducing the polluted air into the second duct section of the conveying device before the milled-off material is thrown off.

Hereinafter, embodiments of the invention are explained in detail with reference to the drawings.

DESCRIPTION OF THE PREFERRED EMBODIMENTS

Figure 1:
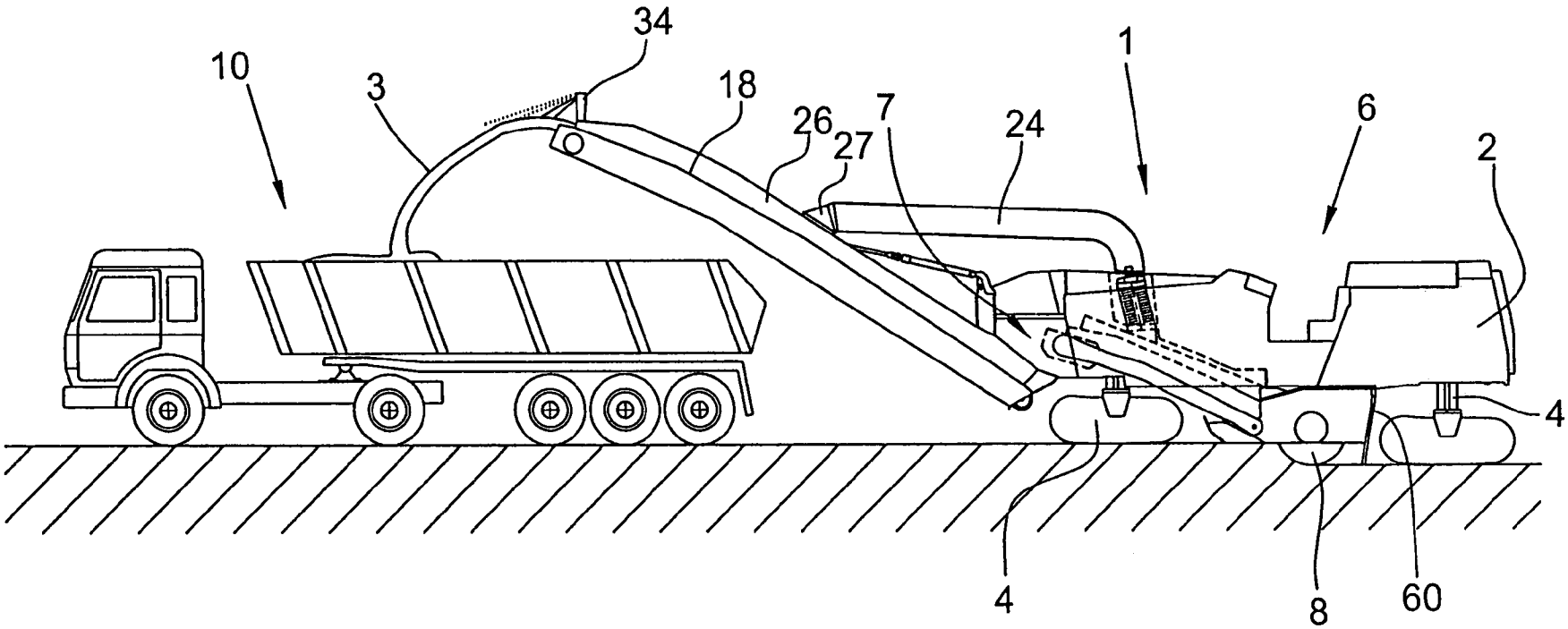
FIG. 1 shows a first embodiment of a front loader milling machine according to the invention.

A milling machine 1 for machining surfaces in the configuration of a front loader milling machine is shown in FIG. 1. It goes without saying that the invention is also applicable to different milling machines which are provided with at least one conveying device 14,18.

The milling machine 1 serves to mill off ground surfaces, particularly roadways of asphalt, concrete or the like. The milling machine 1 comprises a running gear with, e.g., four drive units 4 formed by chain running wheels, which supports the engine frame 2. In the engine frame 2, a milling drum 8 is supported which extends transversely to the traveling direction. The adjustment of the milling depth is effected by means of the height adjustment of the drive units 4. The milling machine 1 illustrated in FIG. 1 is also referred to as a front loader milling machine since it conveys the milled-off material in traveling direction to the front onto a transport vehicle 10. In the traveling direction in front of the milling drum 8, a first conveying device 14 consisting of a band conveyor and comprising a conveyor belt 15 is arranged in a shaft 9 of the engine frame 2 extending at an inclination angle in the engine frame 2. The first conveying device 14 conveys the milled-off material 3 on the conveyor belt 15 to a second conveying device 18 consisting of a band conveyor and comprising another conveyor belt 19. The second conveying device 18 is height-adjustable via an adjustable inclination angle and additionally, it is adapted to be pivoted laterally and, for example, by ±30 so that transport vehicles 10 standing adjacent the lane of the front loader milling machine can be loaded as well. As an alternative to band conveyors, the use of a conveyor worm, for example, which is arranged in a duct is possible as well.

To achieve a transport of the milled-off material as complete as possible, the milling drum 8 is typically surrounded by a drum box 58 where the wall pointing towards the traveling direction is configured as a shield 52 with a passage opening 56 for the milled-off material.

The milling drum 8 is provided with helically arranged chisel tools arranged such that the milled-off material is transported to the passage opening 56 in the shield 52. At the end of the drum box 58 that is located to the rear in traveling direction, a wall 60 of the drum box 58 forming a tight closure with the milled ground surface is provided, which strips off the milled ground surface so that no fragments of the milled-off material remain on the milled ground surface. With its lower edge, the wall 60 is pressed hydraulically against the ground surface to achieve a sealing as good as possible.

At the engine frame 2, a band shoe 50 as a band protecting and supporting means is height-adjustably mounted in a guide. The band shoe 50 receives the rear end of the first conveying device 14. The passage opening 56 of the drum box 58 forms a first transfer location 5 where the milled-off material is transferred from the milling drum 8 onto the first conveying device 14.

In the embodiment of FIG. 1, the driver stand is located above the milling drum 8 but may also be arranged in the rear or front region of the engine frame 2 as is typical with milling machines.

Figure 2:
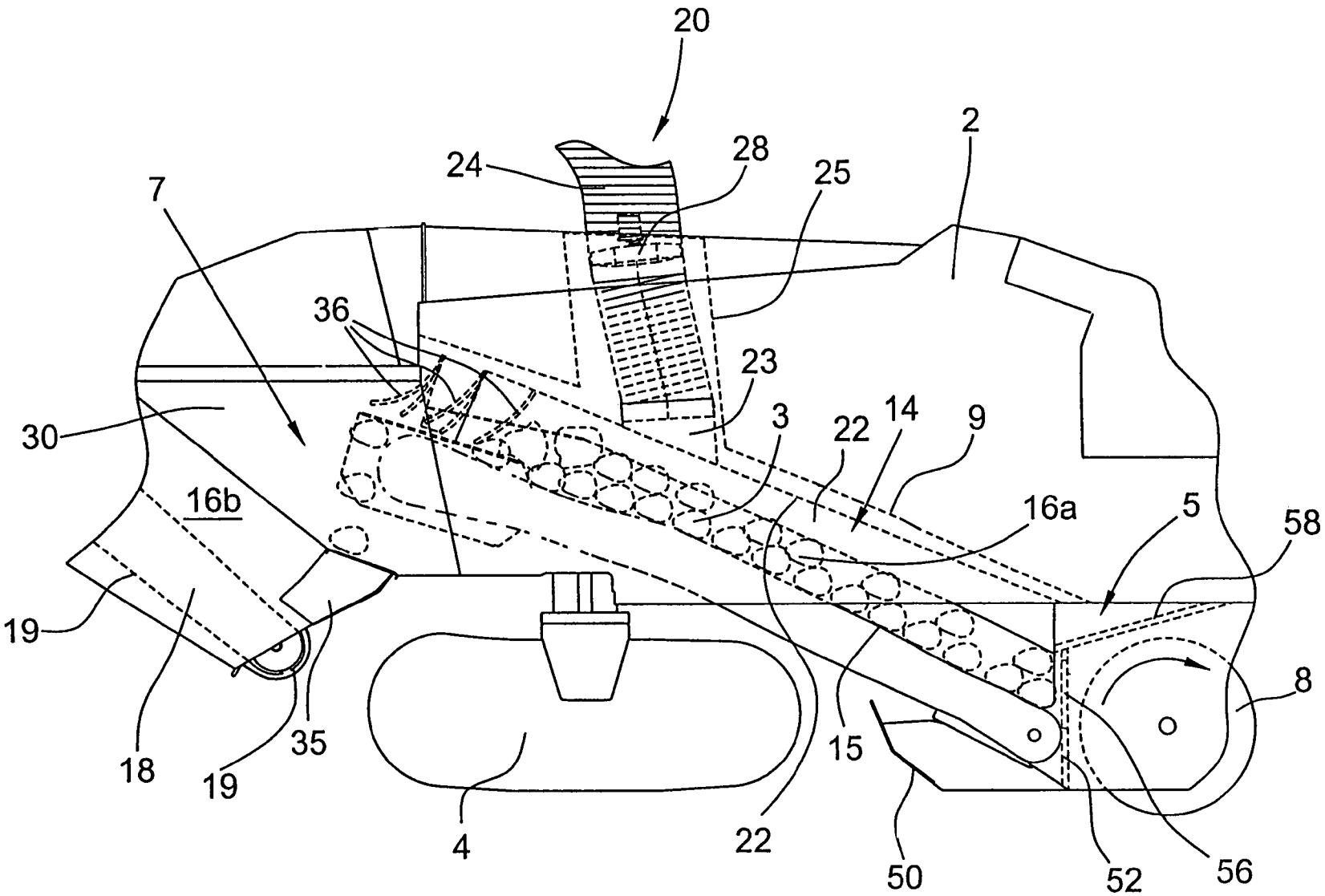
FIG. 2 shows the suction device connected to the conveying device.

FIG. 2 shows the first conveying device 14 in detail.

The conveying device 14 is mounted in a shaft 9 of the engine frame 2, which is preferably arranged centrally, and is adapted to be easily dismounted from the band shoe 50 for maintenance purposes and to be removed through the shaft 9.

The conveying device 14 with the conveyor belt 15 comprises a hood 22 forming, together with the upper carrying run 15*a* of the conveyor belt 15, a duct section 16*a* of a duct 16 extending from the drum box 56 to the end of the second conveying device 18. As can be seen in detail in the cross section of FIG. 3, the hood 22 of the first conveying device 14 is fastened to the frame of the first conveying device 14 by means of hood supports 44. At both sides of the band conveyor, elastic lips 46 are mounted to the hood supports 44 and touch the carrying run 15*a* of the conveyor belt 15 in the border portion over the entire length of the carrying run 15*a*.

Likewise, the second conveying device 18 is provided with a hood 26 also sealed with respect to the carrying run of the band conveyor 19 via sealing lips 46 and mounted at corresponding hood supports 44. Thus, the duct 16 is sealed in a dust- and gas-tight manner with respect to the surroundings.

Figure 4:
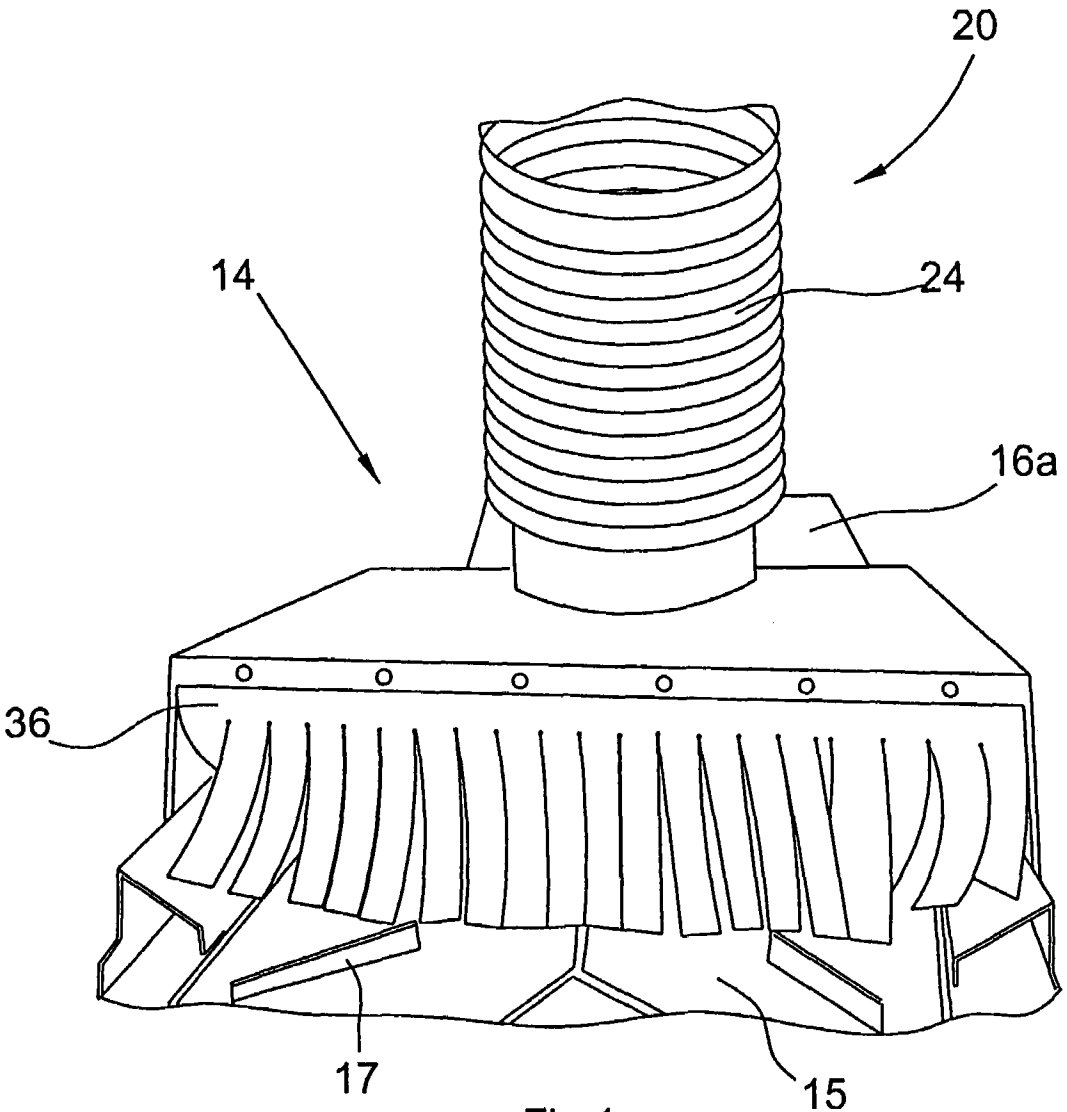
FIG. 4 shows a view of the front-side end of the first band conveyor with the connected suction duct.

In the upper region of the hood 22 near the discharge end but at a distance thereto, the hood 22 of the first conveying device 14 comprises a connection piece 23 projecting substantially vertically upward, to which a suction duct 24 is connectible. To this end, the engine frame 2 comprises a substantially vertical shaft 25 in its center through which shaft the suction channel 24 can come out upward from the engine frame 2. In a first section of the suction duct 24, an axial fan 28 is integrated in the suction duct 24. This has the advantage that the room required for a blower is minimized. The axial fan 28 permits a high air output and therefore, it generates a correspondingly high negative pressure in the first duct section 16*a* and the drum box 56 surrounding the milling drum 8. Therefore, the dusts and fumes produced during the milling process are sucked off reliably and with high efficiency via the suction duct 24. In the region of the first transfer location 5, i.e., at the lower end of the hood 22 and at the passage opening 56 of the drum box 58 and the band shoe 50, respectively, flexible rubber mats may circumferentially seal the transfer location 5. Smaller leakages of the drum box 56 or between the duct 16 and the drum box 56 are unimportant since, due to the negative pressure, polluted air cannot escape but at most, air is sucked in from the environment. As can be seen best from FIG. 4, the upper end of the hood 22 is provided with flexible flaps 36 as separating means between the first and the second duct section 16*a*,16*b*, which, on the one hand, let the milled-off material 3 on the conveyor belt 15 pass and, on the other hand, prevent an airflow opposite to the transport direction of the first conveying device 14. If only a single band conveyor is provided, the separating means are located in the middle of the single conveying device.

To seal the first duct section 16*a* as well as possible at its upper end, the flaps 36 are provided with slots. Preferably, several flaps 36 are arranged behind each other to achieve an improved air sealing between the duct sections 16*a*,16*b*.

Figure 3:
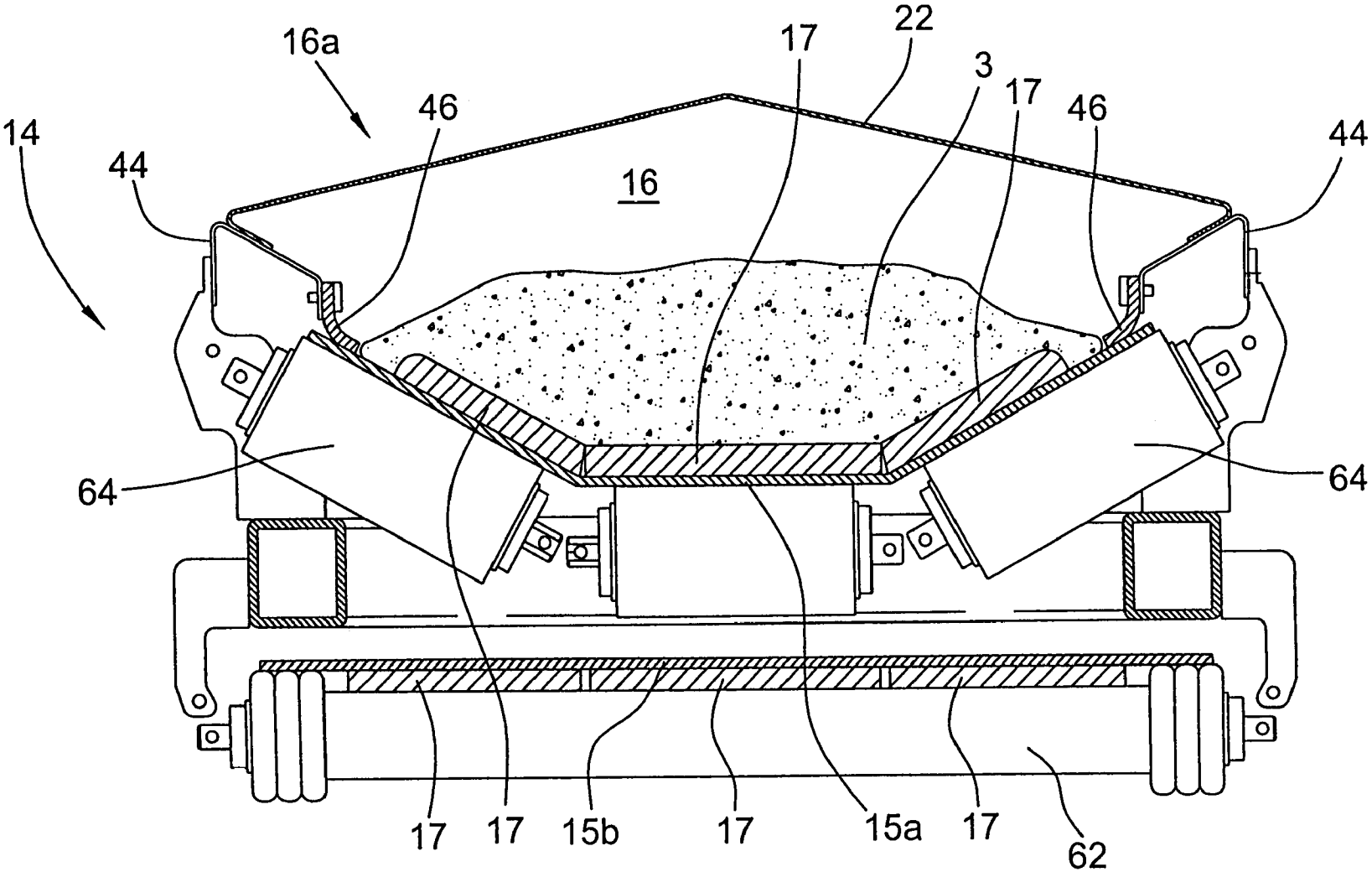
FIG. 3 shows a cross section through the conveying device in the region of the first duct section.

As can be seen best in FIG. 3, the conveyor belt 15 is guided over supporting rollers 62,64, the carrying run 15*a* forming a substantially U-shaped channel because of a corresponding inclination of the supporting rollers 64. The lower supporting roller 62 supports the lower run 15*b* of the conveyor belt 15. As can be seen from FIGS. 3 and 4, webs 17 are located on the surface of the conveyor belt 15, which improve the transport of the milled-off material 3 on the conveyor belt 15.

At the upper end of the conveying device 14, the milled-off material 3 is transferred into a receiving funnel 35 of the second conveying device 18 at the second transfer location 7, whereby the milled-off material 3 is transported over the conveyor belt 19 to the discharge end and disposed of onto the transport vehicle 10.

The transition location at the transfer location 7 is enclosed by sealing means consisting of flexible mats 30 so that the first conveying device 14 and the second conveying device 18 form a circumferentially sealed duct 16 that is continuous in the direction in which the material is conveyed.

At its other end, the suction duct 24 is connected to the hood 26 of the second conveying device 18, the connection piece 27 preferably entering into the duct section 16*b* at a low angle to produce an injection effect in the duct section 16*b* at the high flow speed of the sucked-off polluted air, whereby the lower portion of the duct section 16*b* is sucked as well. To permit an airflow, gaps for sucking air can be left free at suitable sites in the region of the second transfer location 7, e.g., at the sealing means 30. At the upper end of the second conveying device 18, the milled-off material is thrown off, the sucked-off air loaded with dust and fumes with the milled-off material 6 being disposed of together with the milled-off material 3. At the discharge end of the second conveying device, an agglomeration means 34 is preferably provided by means of which dusts can be bound and possibly existing fumes can be condensed. The agglomeration means 34 may consist of a water spraying means, the dusts and fumes being segregated, for example, with a spray. Preferably, the agglomeration means 34 is arranged outside the duct section 16*b* at the discharge end of the second conveying device 18, but it could also be arranged within the second duct section 16*b*.

The milling machine 1, however, could also be used without an agglomeration means 34 since the dusts and fumes are disposed of very far from the driver stand so that the working conditions on the driver stand and in the working area about the machine are considerably improved even without an agglomeration means 34.

Figure 5:
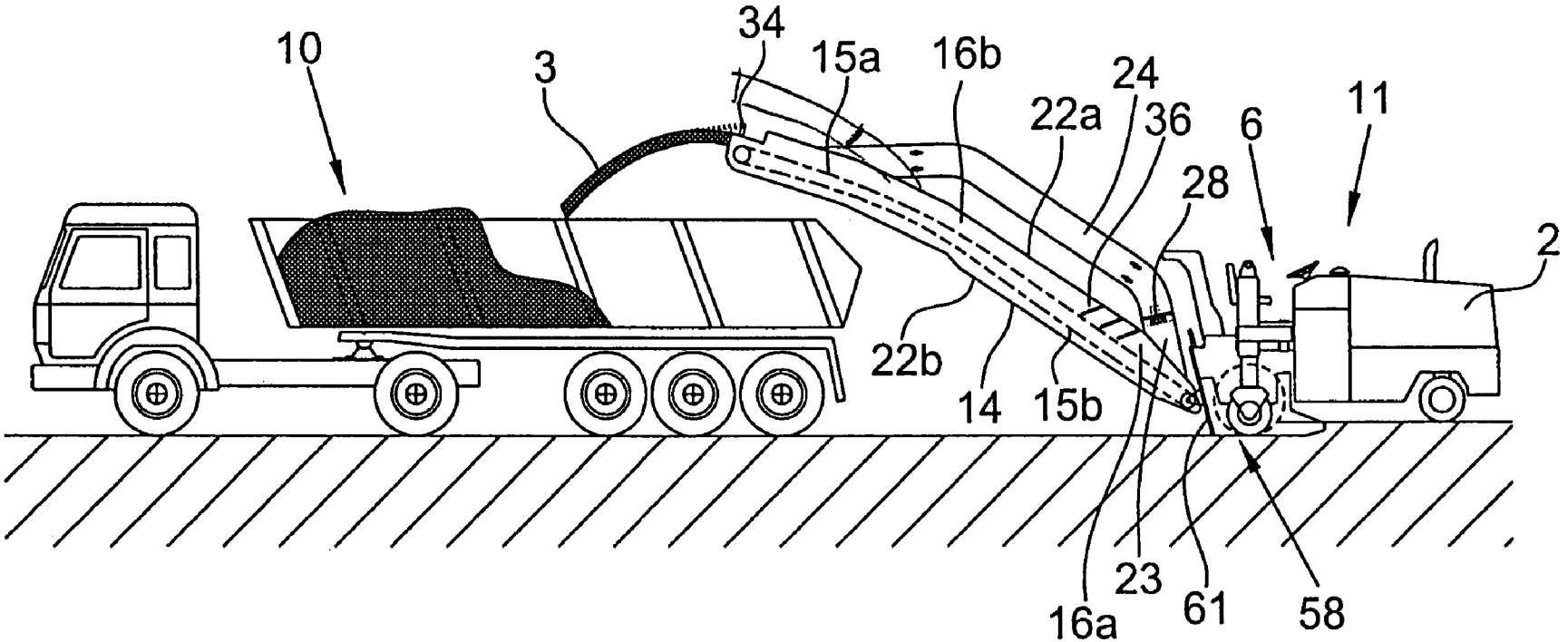
FIG. 5 shows a second embodiment of a rear loader milling machine according to the invention.

FIG. 5 shows a second embodiment of the invention with reference to the example of a rear loader milling machine 11 with only a single conveying device 14. In a rear loader milling machine, the passage opening for the milled-off material 3 is located in the wall 61 of the drum box 58, which points towards the direction opposite to the traveling direction and is configured as a stripper. Directly at this transfer location 5, the material 3 milled off by the milling drum 8 is transferred onto the band conveyor of the single conveying device 14, which is arranged at the rear end of the rear loader milling machine 11. The conveyor belt 15 of the conveying device 14 conveys the milled-off material onto a transport vehicle 10. Like the conveying device 18 of the embodiment of FIG. 1, the conveying device 14 is pivotable in its inclination as well as laterally.

As can be seen from FIG. 5, the connection piece 23 is directly connected to an upper hood portion 22*a* of the conveying device 14 at the lower end. As in the first embodiment, flexible flaps 36 abutting on the carrying run 15*a* of the conveyor belt 15, as is fundamentally apparent from FIG. 4, serve as separating means between the duct sections 16*a*,16*b*. Preferably, several flaps are arranged behind each other, which permit an unhindered transport of the milled-off material 3 from the first duct section 16*a* into the second duct section 16*b* but largely prevent an airflow between the two duct sections 16*a*, 16*b*. The polluted air sucked off via the suction duct 24 reenters into the duct 16 at the upper end of the conveying device 14, namely into the duct section 16*b* near the discharge end of the conveying device 14.

Figure 6:
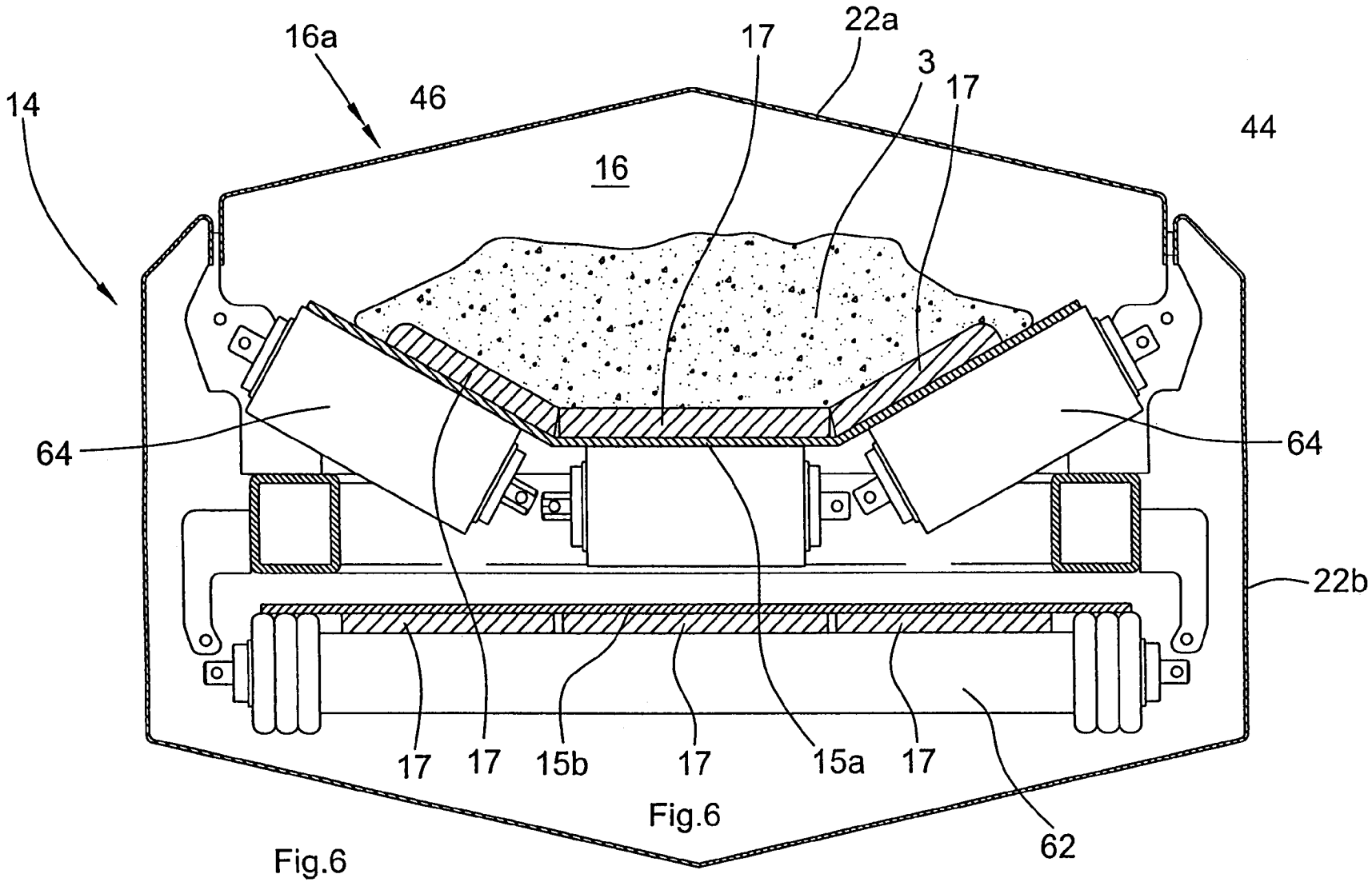
FIG. 6 shows a cross section through the conveying device according to a second embodiment of a hood.

FIG. 6 shows a second embodiment of a hood 22 formed of two hood portions 22*a*,22*b*.

Compared with the embodiment of FIG. 3, the sealing lips 46 may be omitted; in this case, the duct cross section is defined by matching hood portions 22*a* and 22*b*.

Although a preferred embodiment of the invention has been specifically illustrated and described herein, it is to be understood that minor variations may be made in the apparatus without departing from the spirit and scope of the invention, as defined by the appended claims.

The invention claimed is:

1. An automotive milling machine (1,11) for machining ground surfaces comprising an engine frame (2), a milling drum (8) supported on the engine frame (2), at least one conveying device (14,18) which is arranged on the engine frame (2) and takes over the milled-off material (3) from the milling drum (8) at a first transfer location (5), a suction device (20) for air that is polluted with dust and fumes, the at least one conveying device (14,18) for the milled-off material (3) being enclosed by a duct (16), the duct (16) enclosing the conveying device (14,18) being divided into first and second duct sections (16*a*, 16*b*) with a second transfer location (7) being located therebetween, the suction device (20) being connected to the first duct section (16*a*) of the duct (16) downstream from the first transfer location (5) for the milled-off material (3), the suction device (20) sucks off air polluted during milling inside the first duct section (16*a*) substantially in the direction in which the milled-off material (3) is conveyed, and the second duct section (16*b*) being separated from the first duct section (16*a*) by means (36) for blocking airflow without hindering the transport of the milled-off material (3).

2. The milling machine according to claim 1, characterized in that the suction device (20) comprises a suction duct (24) connected to the first duct section (16*a*).

3. The milling machine according to claim 2, characterized in that the suction duct (24) comprises an axial fan (28) integrated into the suction duct (24).

4. The milling machine according to claim 2, characterized in that a downstream end of the suction duct (24) opens into the second duct section (16*b*).

5. The milling machine according to claim 1, characterized in that the suction device (20) disposes of the polluted air where dust develops as a consequence of the discharge from the conveying device (14,18).

6. The milling machine according to claim 1, characterized by means for sealing the duct (16) against the at least one conveying device (14,18).

7. The milling machine according to claim 1, characterized in that the at least one conveying device (14,18) includes a band conveyor with a conveyor belt (15,19), and the duct (16) is formed of hoods (22,22*a*,22*b*,26) sealing against the conveyor belt (15,19) or against the housing of the at least one conveying device (14,18).

8. The milling machine according to claim 1, characterized in that a second conveying device (18) takes over the lied-off material at the end of the first conveying device (14) at the second transfer location (7), and that the second transfer location (7) between the first and the second conveying device (14,18) is circumferentially sealed by flexible sealing means (30) connected to the conveying devices (14,18) so that a continuous duct is formed over both conveying devices (14,18).

9. The milling machine according to claim 3, characterized in that the suction duct (24) opens into the second duct section (16*b*) of the conveying device (14,18) at an acute angle.

10. The milling machine according to claim 1, characterized by means (34) for agglomerating the dusts and/or for condensing the fumes arranged behind a junction of the suction duct (24) and the second duct section (16*b*) of the at least one conveying device (14,18).

11. The milling machine according to claim 10, characterized in that the agglomerating means (34) includes means for spraying water arranged at the discharge end of the at least one conveying device (14,18).

12. The milling machine according to claim 1, characterized in that the separating means (36) between the first duct section (16*a*) and the second duct section (16*b*) of the at least one conveying device (14,18) include at least one flexible flap extending over the entire open cross section of the duct section (16*a*).

13. The milling machine according to claim 7, characterized in that hood supports (44) for the hoods (22,26) are mounted to the sides of a band conveyor, and said hood supports being sealed against the conveyor belt (15,19) of the band conveyor by an elastic lip (46).

14. A method of disposing of dusts and fumes produced during the milling of a ground surface comprising the steps of milling a ground surface and thereby producing milled-off material and an accompanying dust and fumes air admixture, conveying the milled-off material and admixture along a first substantially closed path of travel in a first direction toward a transfer location, transferring at the transfer location the milled-off material from the first substantially closed path of travel to a second substantially closed path of travel, conveying the milled-off material along the second substantially closed path of travel toward a discharge location, and blocking airflow beyond the first substantially closed path of travel without blocking the transfer of the milled-off material at the transfer location to the second substantially closed path of travel whereby the admixture is substantially precluded from entering atmosphere at the discharge location.

15. The method as defined in claim 14 including the step of agglomerating the sucked-off admixture with the milled-off material along the substantially closed second path of travel to thereby assure the admixture does not enter the atmosphere.

16. The method as defined in claim 14 including the step of agglomerating the sucked-off admixture with the milled-off material contiguous the discharge location to thereby assure the admixture does not enter the atmosphere.

17. The method as defined in claim 14 wherein the sucking off the admixture creates an airflow in the substantially closed first path of travel corresponding to the first direction.

18. The method as defined in claim 15 including the step of agglomerating the sucked-off admixture with the milled-off material contiguous the discharge location to thereby assure the admixture does not enter the atmosphere.

19. The method as defined in claim 15 wherein the sucking off the admixture creates an airflow in the substantially closed first path of travel corresponding to the first direction.

* * * * *